United States Patent [19]

Celette

[11] Patent Number: 4,463,937

[45] Date of Patent: Aug. 7, 1984

[54] APPARATUS FOR A GAUGE BLOCK FOR THE INSPECTION AND/OR REPAIR OF MOTOR VEHICLE BODYWORKS

[75] Inventor: Germain Celette, Vienne, France

[73] Assignee: Celette S.A., Vienne, France

[21] Appl. No.: 363,433

[22] Filed: Mar. 30, 1982

[30] Foreign Application Priority Data

Apr. 3, 1981 [FR] France ..... 81 06733

[51] Int. Cl.[3] ..... B21D 1/12

[52] U.S. Cl. ..... 269/17; 269/60; 269/61; 269/296; 74/665 C; 72/705

[58] Field of Search ..... 269/296, 60, 61, 17; 72/705, 305, 311, 446, 457; 187/8.43; 74/625, 665 C, 89.15; 104/93-95; 198/472, 838, 845

[56] References Cited

U.S. PATENT DOCUMENTS

| | | | |
|---|---|---|---|
| 1,847,719 | 3/1932 | Hirschel | 187/8.43 |
| 1,915,024 | 6/1933 | Iogette et al. | 187/8.43 |
| 2,262,330 | 11/1941 | MacNeil et al. | 74/665 C |
| 2,717,020 | 9/1955 | Dobias | 72/705 |
| 2,892,513 | 6/1959 | Corrigan | 187/8.43 |
| 3,026,744 | 3/1962 | Rouse | 74/625 |
| 3,949,976 | 4/1976 | Cofer | 269/17 |
| 4,023,394 | 5/1977 | Borup | 72/705 |
| 4,238,951 | 12/1980 | Grainger et al. | 72/705 |
| 4,337,636 | 7/1982 | Clausen | 72/457 |

*Primary Examiner*—Robert C. Watson

*Attorney, Agent, or Firm*—Young & Thompson

[57] ABSTRACT

Apparatus for the positioning of an automobile vehicle bodywork on an inspection and/or repair gauge block of the type comprising two parallel longitudinal members having an I-section. The apparatus comprises two cross members for disposition beneath the longitudinal members the cross members being mounted for movement along the longitudinal members by means of rollers rolling on the lower flanges of the longitudinal members. The extremities of these cross members each carry, outside the gauge block, a lateral bracket containing a sliding vertical arm the upper extremity of which carries an element adapted to support the base of a vehicle body. This element is movably mounted in the transverse direction while mechanical control structure is provided permitting sliding the vertical arm in order to adjust the position of this support element in the vertical direction.

9 Claims, 9 Drawing Figures

APPARATUS FOR A GAUGE BLOCK FOR THE INSPECTION AND/OR REPAIR OF MOTOR VEHICLE BODYWORKS

BACKGROUND OF THE INVENTION

The present invention relates to apparatus utilised for the positioning of an automobile vehicle bodywork on an inspection and/or repair gauge block.

To effect the inspection or repair of a bodywork on a gauge block it is appropriate that the bodywork should be placed on the block in a precise position responding to the two following conditions:

(a) The lower plane of the bodywork must be positioned parallel with the upper plane of the guage block before being fixed in place;

(b) Likewise the longitudinal axis of the bodywork must coincide with the axis of the guage block.

If these two conditions are not respected, the inspection measurements taken will be inexact. Moreover repairs cannot be effected suitably since suitable reference points are not available.

STATEMENT OF PRIOR ART

At the present the positioning of a bodywork on a guage block is effected by the use of an elevator bridge or another similar contrivance capable of raising and supporting the whole weight of the bodywork in its presentation above the guage block. However, as this prior presentation is effected without any precision of position of the bodywork, the position of the bodywork must then be modified until the two above-stated conditions are respected, after which it is possible to proceed to the fixing of the bodywork on the guage block. However, the operations to be carried out are not very practical and it is necessary to have available a relatively costly and bulky hoist apparatus.

OBJECT OF THE INVENTION

An object of the invention is to provide apparatus capable of permitting easy and precise positioning of a bodywork on an inspection and repair gauge block without the necessity of using a hoist apparatus other than a simple jack. Moreover this device is designed in such manner that it is capable of equipping the inspection and repair gauge blocks which are most usual at present, and which are constituted by two parallel longitudinal members having an I-section, united by a certain number of cross pieces.

SUMMARY OF THE INVENTION

According to the invention apparatus is provided for a guage block comprising a guage block for the inspection and/or repair of automobile vehicle bodyworks, for the easy positioning of such bodywork on a gauge block having two parallel longitudinal glanged members, comprising two cross members for disposition beneath these longitudinal members rollers carrying said cross-members for movement along said longitudinal members rolling on flange thereof, a lateral bracket mounted at each of the extremeties of the cross members, at the exterior of the gauge block, sliding vertical arms extending from the upper extremity of said brackets respectively an element carried by each arm adapted to support the base of a bodywork, said element being mounted movably in the transverse direction, control means for the vertical arms for adjusting the position thereof in the vertical direction.

Thus the support elements of this device can be displaced in three directions at right angles to one another in space, respectively by displacement of the movable cross members, raising of the vertical arms supporting them and transverse displacement on the upper extremities of these arms. Under these circumstances this device is in fact capable of permitting easy positioning of a bodywork on a guage block, in the exact desired position.

In fact the positioning of a bodywork can be carried out very easily in two actions with a simple trolley jack. In a first action, the front of this bodywork is raised with the aid of such a jack and the gauge block is brought beneath the vehicle so that the corresponding part of the bodywork rests on the support elements of a first movable cross member of the present device. Then in the second action the rear of the vehicle is raised with the same trolley jack and the gauge block is moved beneath the vehicle in such manner that the bodywork comes to rest on the support elements of the second movable cross member. In this positioning the support elements are sufficiently raised so that the bodywork may be maintained spaced from the upper surface of the gauge block. It is then sufficient to re-lower the assembly to bring the bodywork on to the gauge block in the desired position, the longitudinal axis of the bodywork having been previously in accordance with the axis of the vehicle.

The brackets provided on the extremities of the movable cross members are preferably fixed thereon in removable manner. Thus this permits of withdrawing them after fixing of a bodywork on the corresponding gauge block.

According to another advantageous characteristic, each of these brackets comprises two distinct mechanisms permitting of controlling the vertical displacement of the arm carrying the corresponding support element, namely:

A mechanism with slow speed and great reduction ratio, intended to be used when the bodywork is in place, and a high speed mechanism capable of being used in the absence of this bodywork.

BRIEF DESCRIPTION OF DRAWINGS

However further particular features and advantages of the present device will appear in the course of the following description which is given by way of example with reference to the accompanying drawings wherein.

BRIEF DESCRIPTION OF PREFERRED EMBODIMENTS

As already indicated, the present device is intended to equip the currently most usual gauge blocks, that is to say gauge blocks constituted by two parallel longitudinal members 1 of I-section united by a certain number of cross pieces 2, the assembly being mounted on small wheels 3 for movement on the ground.

The present device comprises two movable cross members 4 disposed beneath the longitudinal members 1 and suspended from them.

Figure 5:
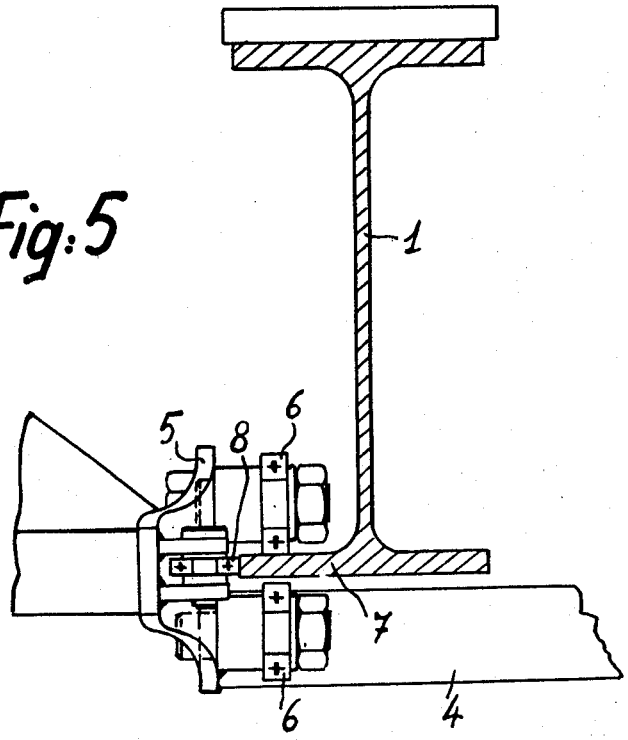
FIG. 5 is a view in section along the line V—V in FIG. 3.

For this purpose the extremities of these cross members carry a vertical plate 5 on the internal face of which two sets of rollers 6 are provided adapted to roll on either side of the corresponding lower flange 7 of the longitudinal member 1 (see FIG. 5). At least some of these rollers are removable to permit the withdrawal of these cross members. However on each extremity of the plates 5 there is also provided a roller 8 with vertical axis capable of rolling against the edge of the flange 7.

The extremities of the two movable cross members 4 each carry a bracket designated by the reference 9. This comprises two hollow sections 10 and 11 disposed at right angles, of which the first, situated in extension of the corresponding cross member 4, carries a vertical plate 12 fixed by means of bolts 13 against the respective plate 5. Thus these brackets can easily be dismantled.

The vertical bar 11 of each of these brackets carries an arm 13 mounted for sliding within the vertical bar, the upper extremity of which arm carries a piece 14 in the form of an inverted stirrup. This piece constitutes a kind of cradle disposed in the transverse direction, that is parallel to the corresponding cross member 4, and within which a horizontal rod 16 extends. On this rod there is slidingly mounted a collar 17 intended to receive a removable support element adapted to support one of the base points of a bodywork, for example a pad 15*a* or a fixing gripper 15*b*.

For this purpose the sliding collar 17 carries a sleeve 18 at right angles upon which there can be fixed, by means of a pin 19 or the like, a yoke provided beneath each support element 15*a* or 15*b*. Thus the latter can pivot articulatedly about the assembly pin 19. However, these elements can be removed in order to be exchanged according to cases and needs.

Each of the brackets 9 comprises two distinct control mechanisms permitting the displacement of the arm 13 in the vertical direction. The first of these mechanisms comprises a rotating screw 20 engaged in an axial threading 21 provided in the corresponding arm 13. This vertical screw is fast with a rotating spindle 22 which carries a drive head 23 accessible at the lower part of the respective bracket, which can be operated by means of a removable crank handle 24.

As regards the second drive mechanism, it comprises a rotating spindle 25 disposed horizontally and carrying a further square drive head 26 accessible at the end of the corresponding bracket, this square head being capable of being driven by means of an operating crank handle. Now the spindle 25 is coupled with the spindle 22 by means of two angle gear bevel pinions 27. The ratio is such that the spindle 25 permits of controlling the raising of the arm 13 at slow speed but with a great reduction ratio. On the other hand the spindle 22 is intended to permit rapid control of the displacement of the arm.

Figure 1:
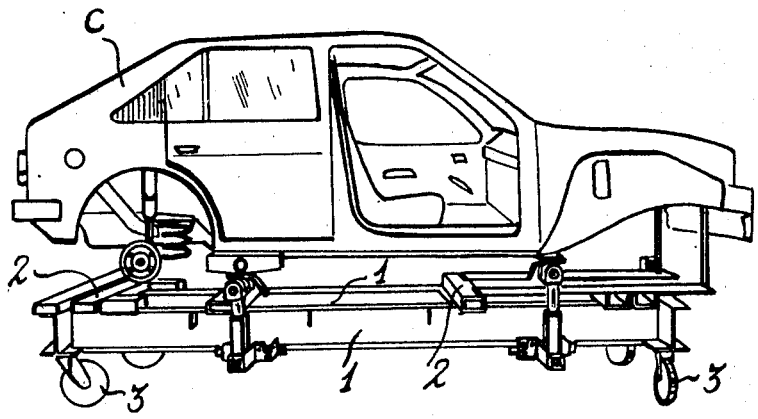
FIG. 1 is a perspective view of a guage block equipped with a device according to the invention supporting an automobile vehicle bodywork.

The present device permits the positioning of a bodywork C on a gauge block equipped therewith, more exactly on the "positive control" securing fittings provided on such a gauge block, or on the various component elements of a measuring apparatus such as that described for example in French Pat. No. 78-11833. The latter case corresponds moreover to the example as illustrated in FIG. 1.

In both cases the present device avoids the use of a "heavy" lifting means such as a mobile hoist bridge or a bridge mounted on two columns. In fact with this device a simple trolley jack is sufficient.

Figure 6:
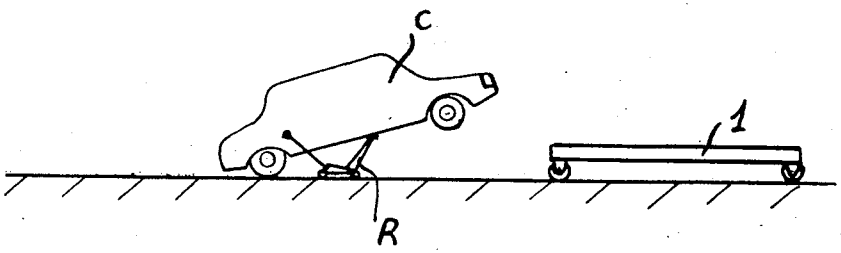

As represented in FIG. 6, the first operation to be carried out consists in raising the front of the vehicle with the aid of a trolley jack R. Then the gauge block is rolled beneath the end thus raised, a first movable cross member 4 of the present device then being fitted in position on this gauge block. It is then possible to make the front of the vehicle fast with the support elements carried by the lateral brackets 9 of this cross member, for example two grippers 15*b* adapted to grip the lateral flange of the base of the bodywork.

Figure 8:
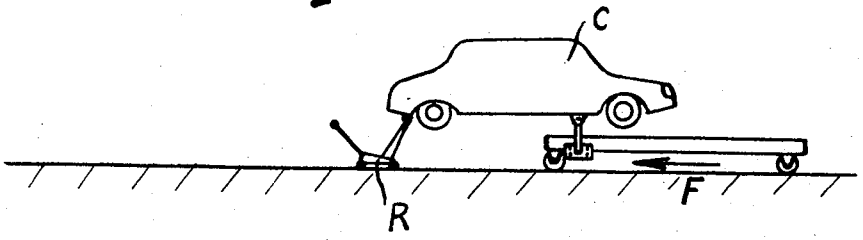

Then as illustrated in FIG. 8 the rear of the vehicle is lifted by means of the same trolley jack R. The gauge block is then rolled beneath the vehicle in the direction of the arrow F. After the second movable cross member 4 of the present device has been positioned, the bodywork is allowed to rest on the support elements carried by the lateral brackets of this cross member, for example pads 15*a*.

Figure 9:
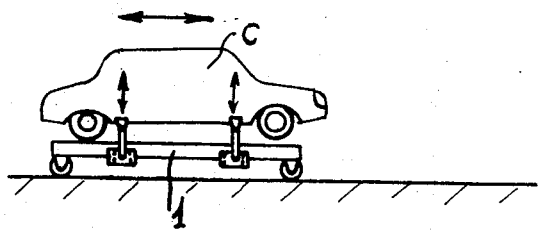

When the bodywork is in position on the present device, as represented in FIG. 9, it is raised in relation to the gauge block 1. It is then very easily possible to effect the adjustment of the exact position of the base of the vehicle in order to bring the points beneath the bodywork which are to be inspected into coincidence with the control fittings provided on the gauge block or with the measuring rods of the measuring apparatus. When the measuring rods or control fittings are in contact with the points to be checked beneath the bodywork, the zeroing of the base of the bodywork on the gauge block is thenceforth obtained. The longitudinal axis of the gauge block then coincides with that of the vehicle and the upper plane of the gauge block is parallel with the lower plane of the base of the bodywork.

After the inspection or repair operations have been carried out the bodywork can of course be withdrawn equally easily from the gauge block by means of the present device.

For all these operations it is appropriate that the movable cross members of this device can be fitted and dismantled very easily. Now this is in fact the case since the lateral brackets 9 can be removed easily and it is then sufficient to withdraw the upper rollers 6 to free each of the movable cross members. For the rest, the ease of dismantlement of the lateral brackets 9 also permits their withdrawal during the operations of inspection or repair of a bodywork.

The adjustment of the exact position of a bodywork in relation to the gauge block is rendered possible by the fact that the support elements 15*a* or 15*b* carried by the lateral brackets 9 can be displaced in three directions at right angles in space. In fact by sliding of the cross members 4 along the longitudinal members 1 it is possible to displace the brackets 9 in the longitudinal direction. Then by raising of the arms 13 it is possible to displace the cradles 14 in the vertical direction. Finally the support elements 15*a* or 15*b* can be displaced horizontally in the transverse direction by sliding on the rods 16.

The presence of two distinct mechanisms on each lateral bracket 9 permits of utilising the mechanism with slow speed and high reduction ratio when the corresponding support element is supporting the load of a bodywork. On the other hand the high speed drive mechanism can be used for the positioning of this support element in contact with the base of the bodywork.

Figure 2:
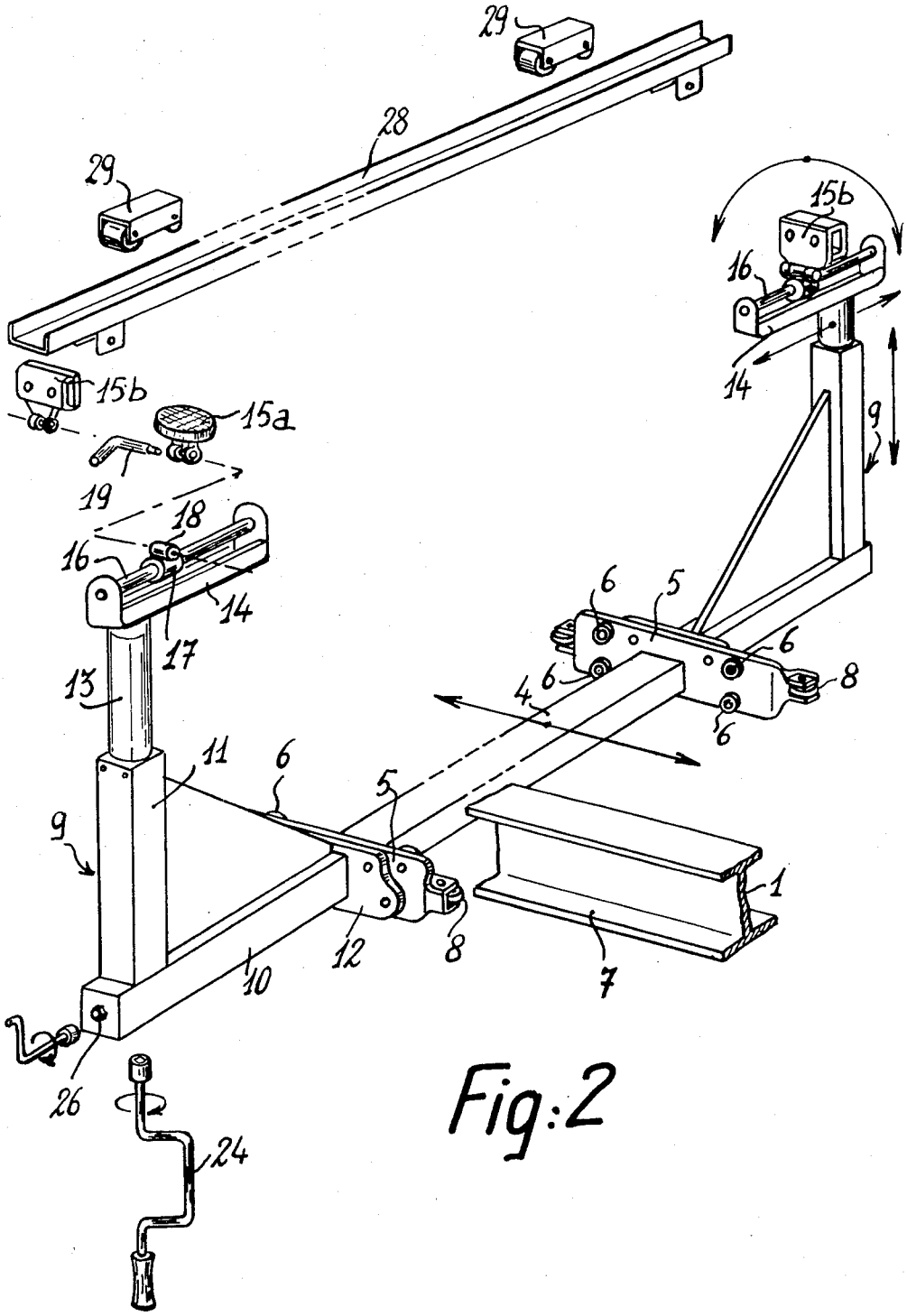
FIG. 2 is a perspective view of one of the movable cross members of this device and of the various elements associated therewith.
Figure 3:
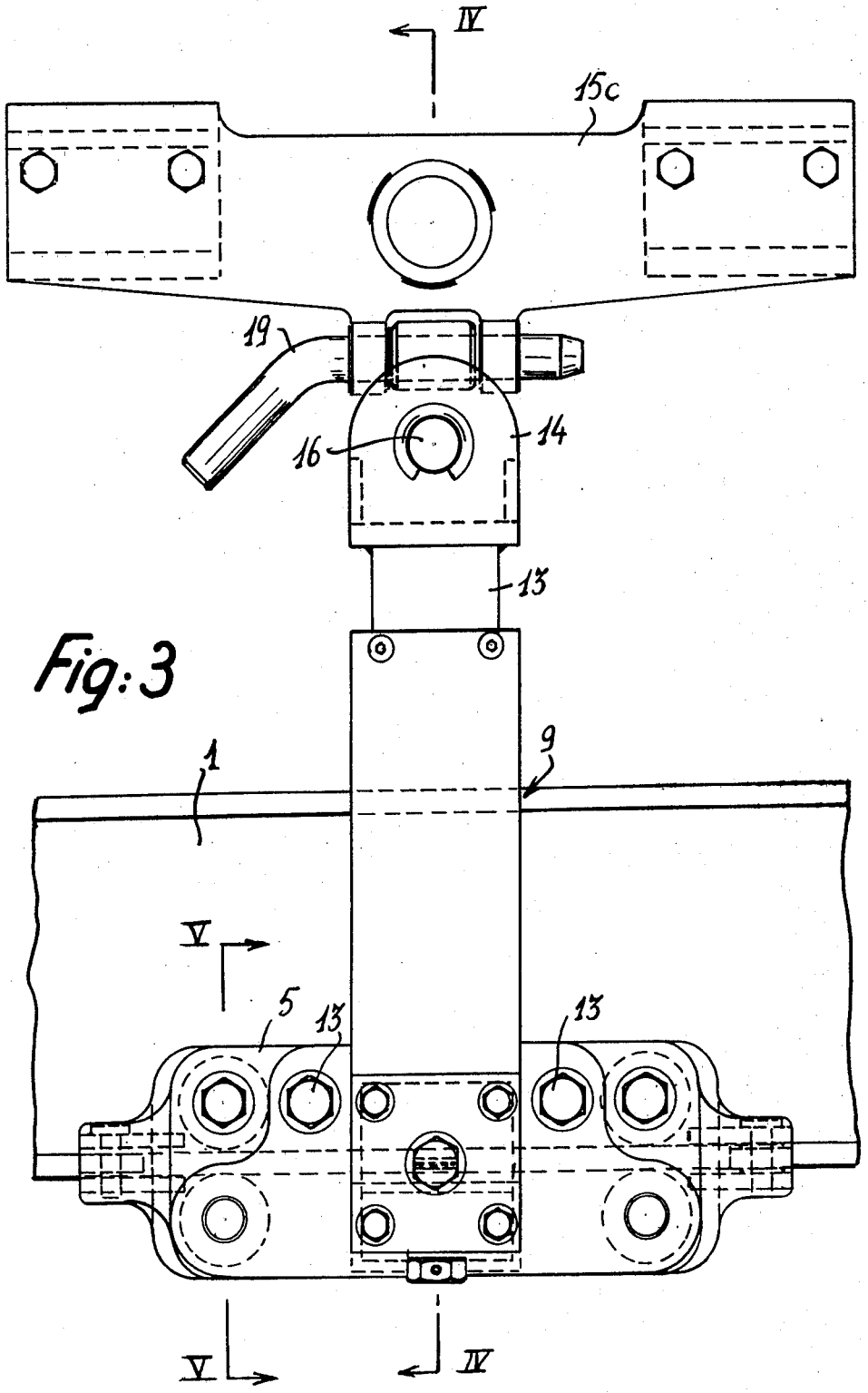
FIG. 3 is a view in end elevation of this cross member, represented on a different scale.
Figure 4:
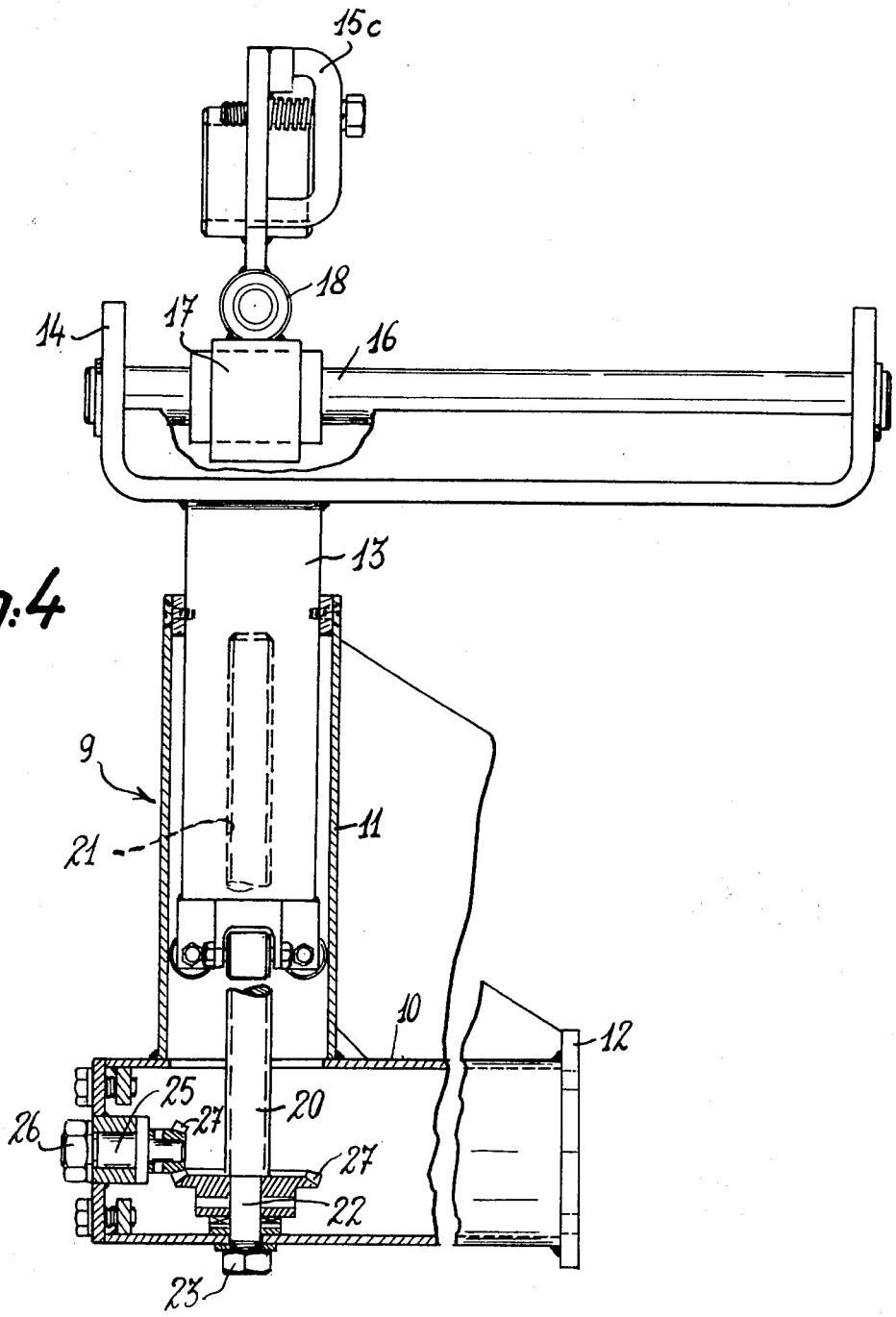
FIG. 4 is a sectional elevational view along the line IV—IV in FIG. 3.
Figure 7:
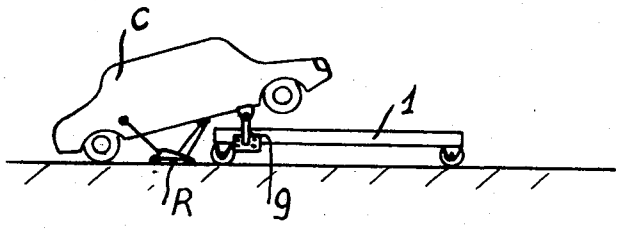
FIGS. 6 to 9 are sketches illustrating the different successive phases of the positioning of a bodywork on a gauge block by means of a device according to the invention.

As already indicated, different types of support elements can be adapted to the cradles 14 carried by the lateral brackets 9. Thus in addition to the pads 15*a* and grippers 15*b* already mentioned, the present device can comprise double-jawed grippers 15*c*. It is however equally possible to unite the cradles 14 carried by the lateral brackets 9 of one and the same cross member 4 with a connection bar 28 carrying two movable skids 29 capable of serving as support elements for the base of a bodywork (see FIG. 2). Under these circumstances, according to cases and needs, it is possible to adapt one or the other of these support elements which can easily be interchanged.

Moreover the present device is not limited to the single example of embodiment described above simply by way of indication. In fact numerous other forms of embodiment and variants can be envisaged. Thus the mechanical systems for control of the vertical arms 13 could be replaced by pneumatic or hydraulic actuators or any other appropriate drive devices.

I claim:

1. Apparatus for a gauge block for the inspection and/or repair of automobile vehicle bodyworks, for the easy positioning of such a bodywork on a gauge block having two parallel longitudinal flanged members, comprising:

(a) two cross members for disposition beneath these longitudinal members, (b) rollers carrying said cross members for movement along said longitudinal members rolling on a flange thereof, (c) a lateral bracket mounted at each of the extremities of the cross members at the exterior of the gauge block, (d) sliding vertical arms extending from the upper extremity of said brackets respectively, (e) an element carried by each arm adapted to support the base of a bodywork, said element being mounted movably in the transverse direction, and (f) control means for the vertical arms for adjusting the position thereof in the vertical direction.

2. Apparatus according to claim 1, wherein each of the lateral brackets of a movable cross member is removable, these brackets being fixable in position by bolting on a vertical plate provided on the corresponding extremity of a movable cross member, which plate serves as support for the rollers of this extremity.

3. Apparatus according to claim 2, wherein at least some of the rollers of the extremities of the movable cross members are removable to permit the withdrawal of these cross members.

4. Apparatus according to claim 1, wherein each lateral bracket comprises two distinct control systems permitting of sliding the corresponding vertical arm, a first control system having a slow speed but great reduction ratio and a second system of low reduction but high speed.

5. Apparatus according to claim 1, wherein the upper extremity of the vertical arm of each lateral bracket carries a piece in the form of an inverted stirrup constituting a cradle disposed in the transverse direction, within which there is disposed a horizontal rod carrying a sliding collar intended to receive an element adapted to serve as support for one of the points of the base of a bodywork.

6. Apparatus according to claim 5, wherein the sliding collar provided on the upper extremity of each lateral bracket carries a sleeve at right angles, on which a support element can be mounted in articulated manner, by means of an assembling pin.

7. Apparatus according to claim 1, wherein the support elements are support pads.

8. Apparatus according to claim 1, wherein the support elements are fixing grippers.

9. Apparatus according to claim 1, wherein the support elements are adaptable to the upper extremities of the lateral brackets and comprise connection bars carrying movable skids adapted to serve as support elements each of these bars being capable of being fixed at its extremities on the lateral brackets of one and the same movable cross member.

* * * * *